United States Patent [19]

Vogelhuber et al.

[11] 4,401,025

[45] Aug. 30, 1983

[54] DEVICE FOR PIVOTING A PRINTING UNIT

[75] Inventors: Peter Vogelhuber, Brigachtal; Hans-Joachim Wysk, Villingen-Schwenningen, both of Fed. Rep. of Germany

[73] Assignee: Kienzle Apparate GmbH, Villingen, Fed. Rep. of Germany

[21] Appl. No.: 375,212

[22] Filed: May 5, 1982

[30] Foreign Application Priority Data

May 8, 1981 [DE] Fed. Rep. of Germany ..... 3118205

[51] Int. Cl.[3] ..... B41J 3/00

[52] U.S. Cl. ..... 101/93.05; 400/124

[58] Field of Search ..... 101/93.05; 400/124, 400/160, 161, 904

[56] References Cited

U.S. PATENT DOCUMENTS

| | | | |
|---|---|---|---|
| 3,882,985 | 5/1975 | Liles | 101/93.05 |
| 4,086,997 | 5/1978 | Wu | 101/93.05 |
| 4,141,660 | 2/1979 | Bommersheim | 400/124 |
| 4,233,895 | 11/1980 | Wehler | 101/93.05 |

FOREIGN PATENT DOCUMENTS

| | | | |
|---|---|---|---|
| 2331628 | 6/1973 | Fed. Rep. of Germany | 400/124 |
| 2343859 | 8/1973 | Fed. Rep. of Germany | 400/124 |
| 2847577 | 5/1980 | Fed. Rep. of Germany | 101/93.04 |

OTHER PUBLICATIONS

"Multicolor Matrix Impact Printer", Meter IBM Technical Disclosure Bulletin, vol. 21, No. 11, Apr. 1979, pp. 448–451.

*Primary Examiner*—E. H. Eickholt

*Attorney, Agent, or Firm*—Toren, McGeady and Stanger

[57] ABSTRACT

A printing unit is guided along a straight line in parallel relation with the printing plane of a printing support. A device is arranged to pivot the printing unit between at least two printing supports spaced angularly apart. The device includes a coupling assembly interconnecting the printing unit with a drive member. A part of the coupling assembly includes a slotted crosshead or plate in which rollers move through branch slots disposed angularly to one another. Due to the guidance afforded the printing unit as it is pivoted between different angularly spaced printing supports, it moves along a curve significantly flatter than the arc of a circle on which the printing planes of the printing supports are located.

13 Claims, 5 Drawing Figures

DEVICE FOR PIVOTING A PRINTING UNIT

SUMMARY OF THE INVENTION

The present invention is directed to a device for pivoting a printing unit, movable along a straight line parallel to the printing plane of a printing support, between two printing positions each located at a different printing support. The printing unit includes a carrier and a printing head mounted on the carrier with the unit supported on a guide shaft for movement between a pair of side members spaced apart by a distance corresponding to the largest possible printing support.

In the Federal Republic of Germany Offenlegungsschrift No. 28 23 153, a pivoting device is disclosed where a printing head on a printer moves with its printing point—the printing point is defined as the point where the central printing needle of the needle printer touches the printing support—along a circle from one printing position to another relative to two different supports. This movement of the printing head from one position to another has the consequence that the overall arrangement is relatively high with the disadvantage that when the printer is placed on a table for use, because of its height, the operator is unable to view the upper printing position.

Furthermore, during pivoting movement, the printing head moves along a very flat path or curve into the printing position and because of various paper guide parts adjacent the printing position at the printing support, the printing head can be moved along a path so that it does not interfere with the paper guide parts.

Another disadvantage of this known device is that the crank mechanism used for pivoting the printer permits stopping the print head in only two end positions determined by the two dead center positions of the crank mechanism. As a result, it is not possible to pivot the printer only partially between the two end positions.

Therefore, it is the primary object of the present invention to overcome the disadvantages experienced with the known pivoting devices and to provide a device for pivoting a printing unit so that the device has a relatively low height permitting printing on several printing supports whereby an on-the-table printer can be produced in which the operator is able to follow the printing process on the upper printing support.

Another object of the present invention is to drive the pivoting device so that partial pivoting between the end positions can be effected with the pivoting device stopped between the end positions. Further, in these intermediate positions the printing head can be pivoted.

In accordance with the present invention, a coupling assembly is provided between the side members of the printing unit and a driving member. The coupling assembly includes a slotted crosshead or Scotch yoke containing two slots or recesses intersecting one another with rollers movable through the slots for effecting the pivoting of the printing unit between two different printing supports. In the end positions where the printing unit is located for movement in a straight line parallel to a printing support, the printing point of the printing unit extends perpendicularly to the printing plane on the printing support.

In another embodiment of the coupling assembly, a toothed or gear wheel is connected with the side members and during pivotal movement it rolls in meshed engagement with a stationary internally toothed surface of a support or guide part. The diameter of the gear wheel and of the internally toothed surface on the support is in a ratio of 1:2 so that the gear wheel effects the pivoting movement of the printing unit between the two printing positions.

In accordance with the present invention, the printing device has the advantage that the printing unit can be moved from one printing position to the other along a very steep curve as compared to the arcs of the circles on which the printing supports are located whereby the device requires much less space. When the printing unit is moved between two printing positions each opposite a different printing support, the intersecting recesses or slots in the slotted crosshead from two branch slots, one extending perpendicularly to the other with each branch slot extending parallel to the printing plane of one of the printing supports. Such an arrangement has the advantage that during the movement of the pivoting device, as the printing head moves into the printing position, its movement is almost parallel with the printing plane. Therefore, the printing unit does not pass through any paper guide parts or the like so that the pivoting movement can be effected in any lateral position of the printing head.

When a stepping motor is used as the driving element for the pivoting device, a partial pivoting movement is possible so that the printing head is not always moved into one of the end positions, rather it can be pivoted only to the extent that the printing surface or plane can be viewed. When partial positioning of the printing head is carried out, special retraction of the printing head for the purpose of line spacing of the record carrier is no longer required so that the printing unit is simplified.

Another advantage involved in partial pivoting is that the printing head may be moved by a distance less than the width of one needle. In such movement, it is possible by the multiple movement of the printing head over one line to print the same data with better quality, since the second printing operation fills gaps left in the first operation, that is, due to the roundings of the printing needles.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
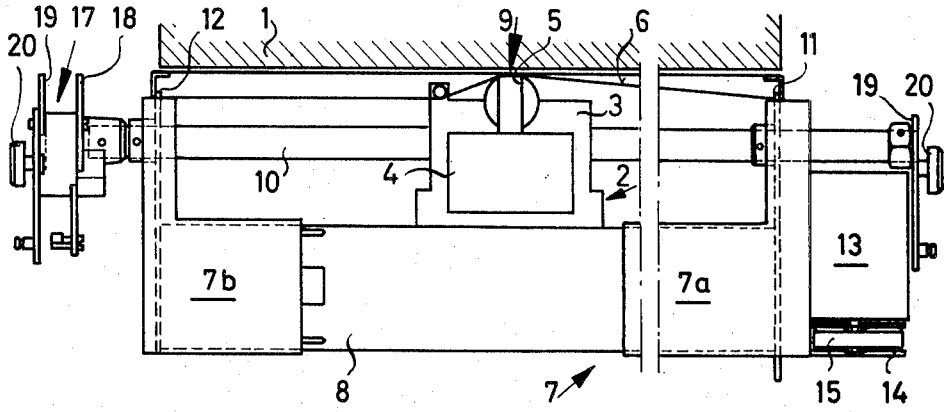
FIG. 1 is a top view of a printing assembly embodying the present invention.

In FIG. 1 a printing unit 2 is positioned in front of a first printing support 1. The printing unit 2 includes a carrier 3 with a printing head 4 mounted on it and including an orifice 5 positioned immediately in front of the printing support 1. A ribbon 6 is positioned between the printing head 4 and the printing support 1 and the printing action is effected by printing needles, not shown, on paper positioned on the printing support 1. The printing needles print on a first printing plane $D_1$ on the printing support 1, note FIG. 4. Ribbon 6 is located in a cassette 7 having two parts 7*a*, 7*b* arranged on a guide member 8 located at the opposite ends of the printing support 1, that is, on the opposite sides of the printing position 9. The ribbon 6 is stored in part 7*a* of the cassette 7 and is moved by driving means located in part 7*b* and is guided in front of the printing position 9.

The printing unit 2 is mounted on and moves along a shaft 10 which acts as a guide for the unit between two side parts 11, 12. As viewed in FIG. 1, a motor 13 is positioned on the right side member 11. By means of a belt wheel 14, a belt 15 and another belt wheel, not shown, the motor moves the printing unit 2 along the guide shaft 10 so that it travels rectilinearly for printing against the first printing support 1.

Figure 3:
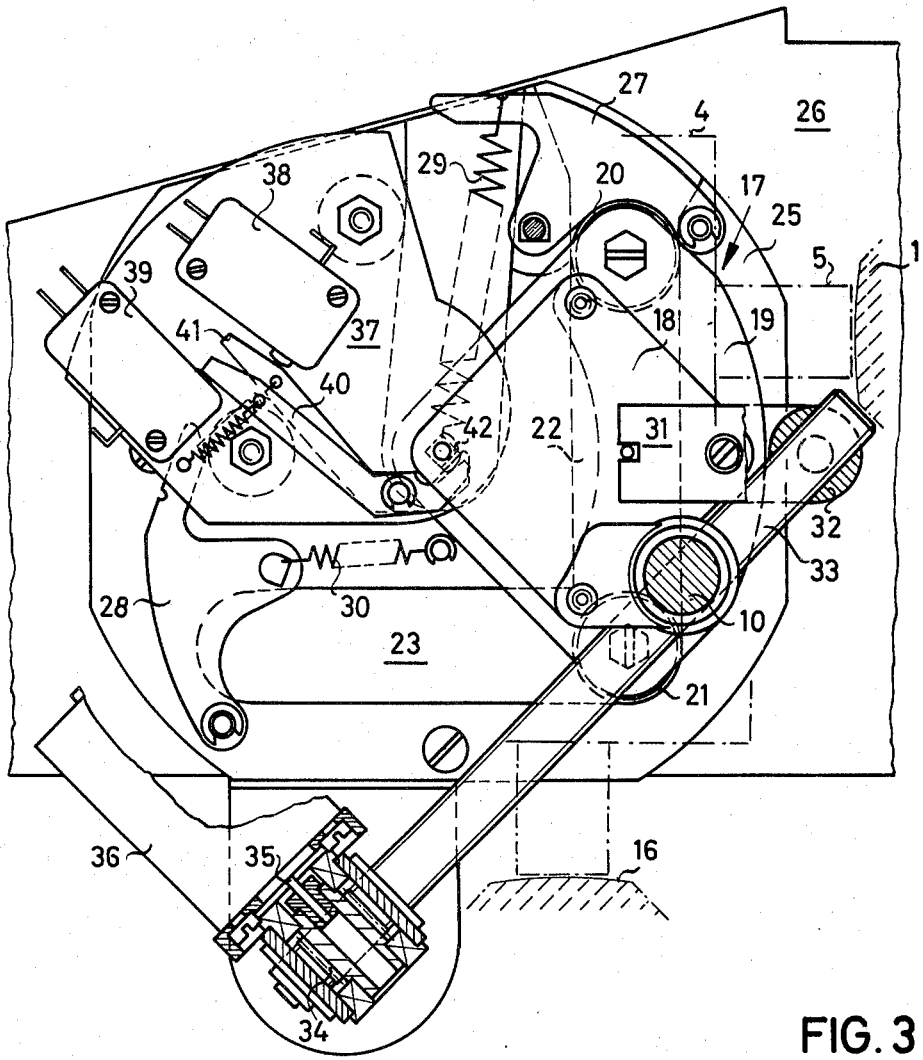
FIG. 3 is a view similar to FIG. 2 showing the other end position of the pivoting device.

A second printing support 16, note FIG. 3, is positioned angularly apart from the first printing support 1 by approximately 90°. In the second printing position at the second printing support 16, the printing head 4 prints downwardly on the printing plane of the support. The printing head 4 moves over a second printing plane $D_2$ formed on the second printing support 16. Perpendicularly of the first printing plane $D_1$ there is a plane $P_1$ containing the printing point $A_1$. Similarly, extending perpendicularly of the second printing plane $D_2$, there is a plane $P_2$ containing the printing point $A_2$. Printing points $A_1$ and $A_2$ refer to the points at which the central printing needle, not shown, touches the printing planes $D_1$, $D_2$.

The combination of the guide shaft 10, the side members 11, 12 and the printing unit 2 can be pivoted by the pivoting device in a manner described in the following so that the printing head 4 can print on either the first printing support 1 or the second printing support 16.

Figure 2:
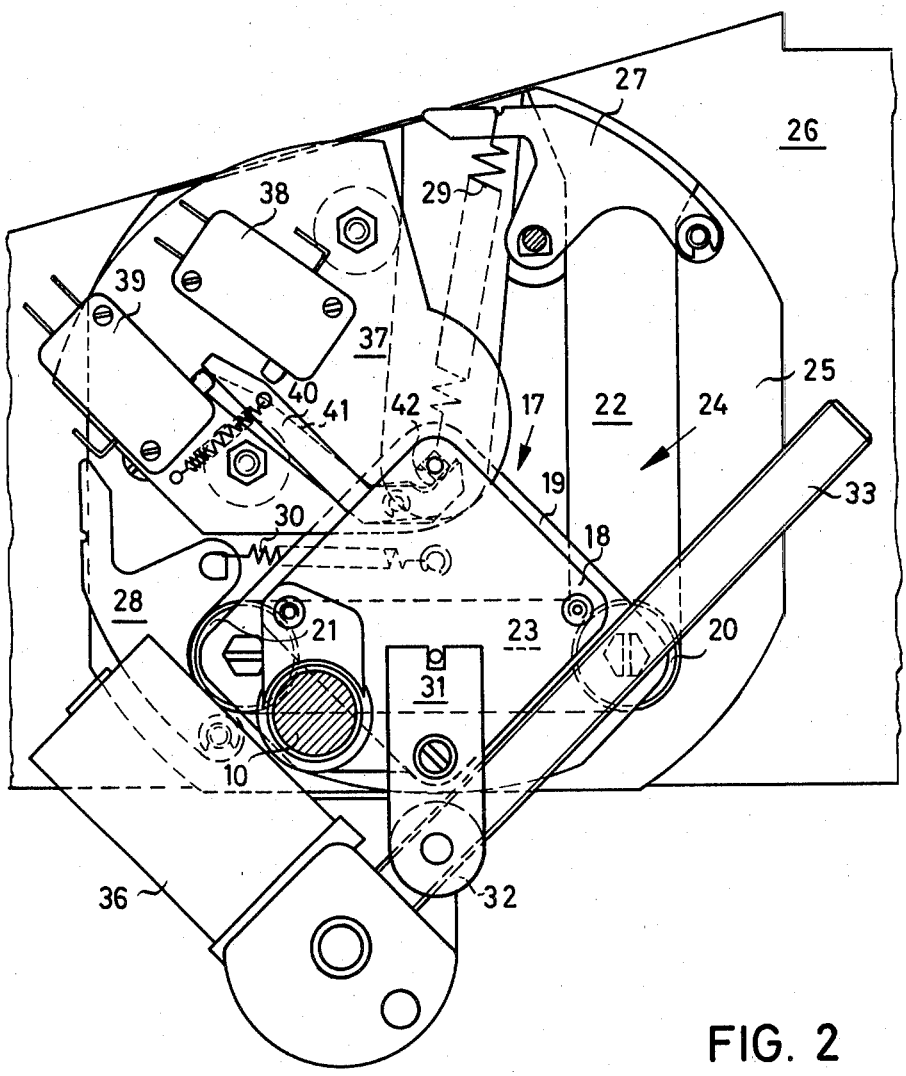
FIG. 2 is an enlarged elevational view illustrating one end position of the pivoting device.

With particular reference to FIGS. 2 and 3, the pivoting device for the printing unit 2 will now be described. As shown in FIG. 1, a coupling assembly 17 is connected between the guide shaft 10 and the side members 11, 12 and the means for pivoting these components. As viewed in FIG. 1, the coupling assembly 17 on the left-hand side consists of two members 18, 19 connected to one another. On the right-hand side in FIG. 1, the coupling assembly includes only member 19. As can be seen in FIGS. 2 and 3, at the opposite ends of the printing supports 1,16, rollers 20, 21 are associated with the member 19. The two rollers 20, 21 are rotatably mounted at two diagonally opposite corners of the four-sided member 19 and the rollers are positioned in the two branch slots 22, 23 of a slotted crosshead or Scotch yoke 24. Rollers 20, 21 define the end points of the pivoting movement afforded by the coupling assembly 17 when located at the ends of the branch slots 22, 23 spaced from their intersection. The slotted crosshead 24 made up of the branch slots 22, 23 is formed in a guide plate 25 fixed to a support or lateral plate 26. The end positions of the rollers 20, 21 within the branch slots 22, 23 spaced from the intersection, are defined by stop levers 27, 28 each of which is under the influence of a spring 29, 30. The levers 27, 28 are at the opposite ends of the branch slots 22, 23 from the intersection of the slots. With roller 21 in the end position illustrated in FIG. 2, the spring 30 is slightly tensioned. As a result of the tensioning of the spring 30, at the commencement of the movement of the coupling assembly 17 from this end position to the other an additional acceleration is afforded so that the pivoting movement can be quickly speeded up. When there is movement in the opposite direction, the spring cushions the pivoting movement as it is contacted by the roller 21. Stop lever 27 acts in a similar manner. When the coupling assembly 17 is in the other end position, note FIG. 3, roller 20 presses against the stop lever 27 so that the spring 29 is slightly tensioned. When movement is effected from the position shown in FIG. 3, the spring serves to accelerate the pivotal movement at the beginning and also cushions the movement as the roller 20 moves against the stop lever 27. Each of the stop levers 27, 28 acts to support the weight of the device.

To pivot the coupling assembly and with it the printing unit 2 and its guide shaft 10 and side members 11, 12, the coupling assembly is connected to a stirrup-shaped part 31 which is pivotally mounted on a nut 32. A driving spindle 33 extends through the nut 32 and the spindle is rotated by a gear wheel 34 driven from the shaft 35 of a stepping motor 36. As the spindle 33 rotates, it moves the nut 32 along the spindle.

As shown in FIGS. 2 and 3, a mounting part 37 located on the plate 26 supports two microswitches 38, 39 with which switching levers 40, 41 cooperate. Bolts 42 on the members 18, 19 control the movement of the switching levers 40, 41 so that one of the microswitches is closed in one end position of the coupling assembly 17 and the other microswitch is closed in the other end position. This arrangement serves to transmit corresponding signals on the position of the coupling assembly to electronic parts.

The various components shown in FIGS. 2 and 3 which effect the driving action, that is, the stepping motor 36, the spindle 33 and the nut 32 on part 31 are arranged on the left-hand side of the printing device as shown in FIG. 1. On the opposite end or right-hand side there is a member 19 of the coupling assembly 17 along with the rollers 20, 21 and the plate 25 forming the slotted crosshead 24. Further, stop levers 27, 28 are located on both sides of the printing device.

To carry out the pivoting movement, the stepping motor 36 is switched on. The motor 36 via its gear wheel 34 drives the spindle 33 so that the nut 32 moves along the spindle and via the stirrup-shaped part pivots the coupling assembly 17 in the direction as shown in FIG. 3. Accordingly, rollers 20, 21 move in the branch slots 22, 23 of the slotted crosshead 24 from the position illustrated in FIG. 3 to the position displayed in FIG. 2. As can be seen in FIG. 3, where the first and second printing supports 1, 16 are shown, the printing head 4 cooperates with the first printing support 1 while in the position of FIG. 2 the printing head cooperates with the second printing support 16.

As mentioned above, it is possible to run the motor so that only individual steps or small movements between the end positions are effected. The printing head can be moved so that a view of the printing position 9 is afforded and the printed matter can be viewed. Further, it is possible to move the printing head by only part of the width of one needle point so that by moving twice over one of the printing supports marks will be produced in which the points normally formed by needle printers are doubled thereby filling in any gaps between individual points.

Figure 4:
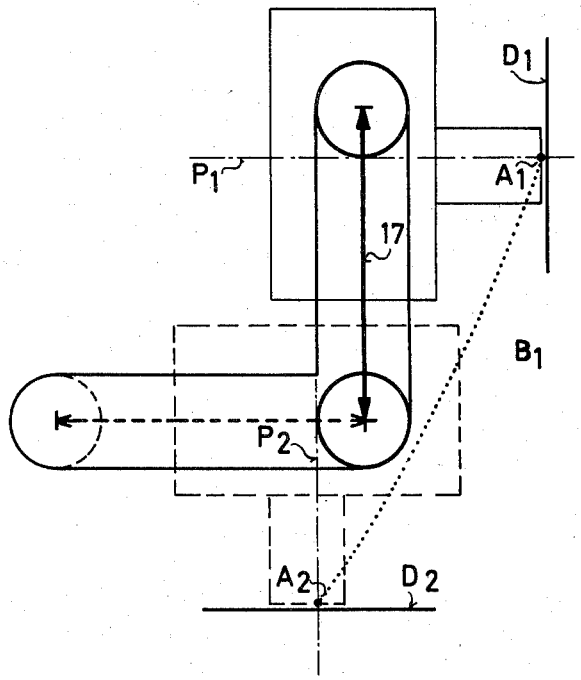
FIG. 4 is a schematic representation of the movement between the two printing positions.

To clarify the basic design principle, FIG. 4 shows in a diagrammatic representation the two printing planes $D_1$, $D_2$, the two end positions of the coupling assembly 17 within the branch slots of the slotted crosshead 24, and the planes $P_1$, $P_2$ in which the printing points $A_1$, $A_2$ extend perpendicularly to the printing planes. In FIG. 4 the coupling assembly 17 are shown schematically in solid lines arranged for printing in the printing plane $D_1$ of printing support 1, and in dashed lines for printing in the printing plane $D_2$ of the printing support 16. In the positions illustrated, the planes $P_1$, $P_2$ intersect at right angles in this schematic showing of the coupling assembly, however, this is not really necessary such as when the branch slots of the slotted crosshead take up another angular position relative to the printing planes. Further, in FIG. 4 a relatively flat or steep curve $B_1$ is shown in dotted line along which the printing head 4 moves between the printing positions represented by points $A_1$ and $A_2$.

Figure 5:
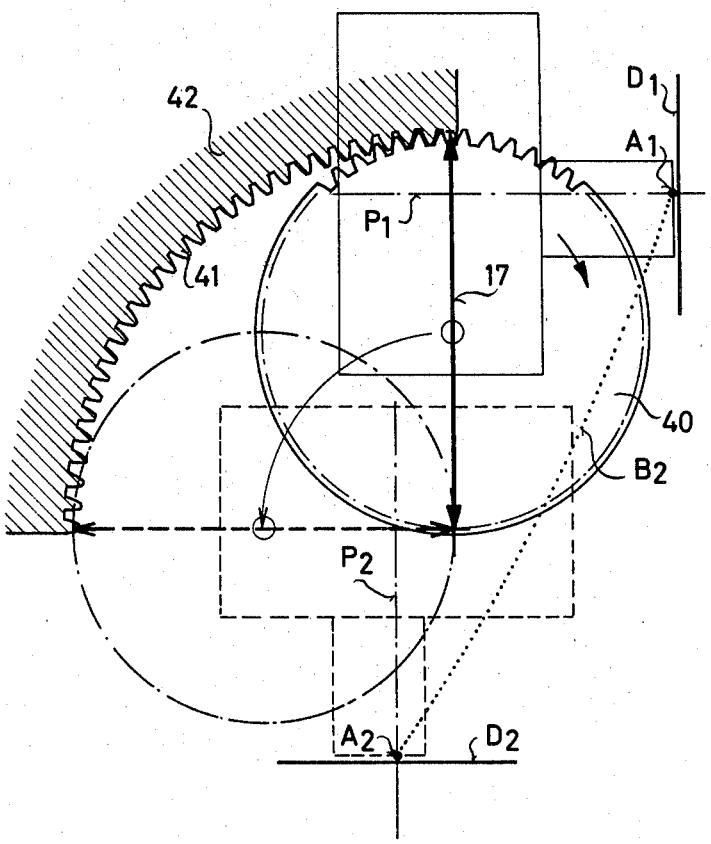
FIG. 5 is a schematic representation of another embodiment of a pivoting device incorporating the present invention.

FIG. 5 shows, in a diagrammatic representation, another coupling assembly usable in place of the embodiment shown in FIGS. 1–4. In this second embodiment the coupling assembly 17 includes a toothed or gear wheel 40 in meshed engagement with a fixed guide member 42 having an internal toothed surface 41. The diameter of the internal toothed surface 41 is twice the diameter of the gear wheel 40. By means of a suitable connection the gear wheel 40 is driven by the spindle 33 and the stepping motor 36 to produce the pivotal movement of the printing device. When the gear wheel is rotated in the clockwise direction it rolls along the internal toothed surface 41 until it reaches, after half a revolution, the position shown in dot-dash lines. In other words, one end position is represented in full lines and the other end position is represented in dot-dash lines. The positions of the printing planes $D_1$, $D_2$ and of the printing head 4 are shown. The end points of the coupling assembly in this embodiment are the points of engagement of the gear wheel 40 with the internal toothed surface 41 in the two end positions with the movement of the center of the gear wheel 40 between the two positions being illustrated by the curved line $K_1$.

In FIG. 5, it can be seen that the printing head pivoted between the two printing points $A_1$, $A_2$ moves along a flat or steep curve $B_2$.

While specific embodiments of the invention have been shown and described in detail to illustrate the application of the inventive principles, it will be understood that the invention may be embodied otherwise without departing from such principles.

We claim:

1. A device for pivoting a printing unit, movable along a straight line parallel to the printing plane of a printing support, between two angularly spaced printing supports with the planes thereof disposed angularly of one another, said printing unit comprising a carrier, a printing head mounted on said carrier and including a printing member arranged to extend transversely of the printing plane of the printing support, a pair of side members spaced laterally apart in the direction of movement of said printing unit relative to the printing support, a guide shaft extending between said side members, said printing unit mounted on said guide shaft for movement thereon in the direction between said side members, and means for pivoting the combination of said guide shaft, side members and printing unit mounted on said guide shaft between angularly spaced printing supports whereby said printing member extends in a plane substantially perpendicular to the printing plane of the printing support and the combination is moved along an arc between the printing supports which arc is significantly flatter than the circular arcs defined by each radius extending from the intersection of the planes of said printing members disposed perpendicularly to the printing planes of the printing supports to a different one of the planes of the printing supports.

2. A device, as set forth in claim 1, wherein said pivoting means includes a support, said support having a pair of intersecting branch slots therein, means engageable with said branch slots and displaceable therethrough, said means engageable with said branch slots being connected to the combination of said guide shaft, side members and printing unit for moving the combination between at least two angularly spaced printing end positions.

3. A device, as set forth in claim 2, wherein said means engageable with said branch slots comprises a first support member, a pair of rollers secured to said first support member in spaced relation thereon, each of said rollers engageable within and rollably displaceable through a different one of said branch slots, said first support member being movably displaceable as said rollers move through said branch slots, and a second support member secured to said first support member and to said combination of said guide shafts, side members and printing unit for movably displacing the combination between the two end positions.

4. A device, as set forth in claim 3, wherein said means for pivoting the combination of said guide shafts, side members and printing unit includes a drive member and means connected to said drive members and to said means engageable with said branch slots for rollably displacing said rollers through said branch slots.

5. A device, as set forth in claim 2, 3 or 4, wherein said branch slots are disposed at right angles to one another.

6. A device, as set forth in claim 4, wherein said drive member comprises a motor, a spindle connected to said motor so that said motor rotates said spindle, a nut mounted on said spindle for movement in the axial direction thereof when said spindle is rotated, and said nut connected to said means engageable with said branch slots for rollably displacing said rollers through said branch slots.

7. A device, as set forth in claim 2, wherein said support comprises a stationary support part, and a plate secured to said stationary support part and forming a slotted crosshead with said branch slots.

8. A device, as set forth in claim 7, including a spring loaded stop lever mounted at the end of each branch slot spaced from the intersecting ends of said branch slots, said levers extending across the ends of said slots and intercepting said rollers moving to the ends of said branch slot so that said springs are tensioned when one of said rollers contacts one of said levers.

9. A device, as set forth in claim 6, wherein said motor is a stepping motor whereby stepped movement of said printing unit between the angularly spaced end positions can be effected.

10. A device, as set forth in claim 2, including a mounting part secured to said support, a pair of microswitches mounted on said mounting part in spaced relation, means engageable with said first support member and with said microswitches for signalling the position of said printing unit in one or the other of said end positions.

11. A device, as set forth in claim 6, wherein a stirrup-shaped part is pivotally secured to said nut and to said means engageable with said branch slots for moving said means relative to said support.

12. A device, as set forth in claim 1, wherein said means comprises a stationary support, and means engageable with said stationary support for movement relative thereto while remaining in contact with said stationary support, and said means engageable with said stationary support being secured to the combination of said guide shaft, side members and printing unit for angularly displacing said printing unit.

13. A device, as set forth in claim 12, wherein said stationary support has an interior toothed surface thereon forming an arc of a circle, and said means engageable with said stationary support comprises a gear wheel disposed in meshed engagement with said interior toothed surface and said gear wheel having a diameter equal to the radius of said interior toothed surface so that as said gear wheel rolls in contact with said interior toothed surface said printing unit can be angularly displaced.

* * * * *